United States Patent [19]

Meshekow

[11] Patent Number: 4,783,585

[45] Date of Patent: Nov. 8, 1988

[54] DOWNHOLE ELECTRIC STEAM OR HOT WATER GENERATOR FOR OIL WELLS

[75] Inventor: Robert L. Meshekow, Los Angeles, Calif.

[73] Assignee: Meshekow Oil Recovery Corp., Beverly Hills, Calif.

[21] Appl. No.: 878,815

[22] Filed: Jun. 26, 1986

[51] Int. Cl.[4] ..... E21B 43/24; F22B 1/30; H05B 3/60; F24H 1/10

[52] U.S. Cl. ..... 219/278; 166/61; 166/303; 219/284; 219/288; 219/289; 219/291; 219/293

[58] Field of Search ..... 219/284–295, 219/277, 278; 166/61, 62, 57, 60, 303

[56] References Cited

U.S. PATENT DOCUMENTS

| | | | |
|---|---|---|---|
| 731,339 | 6/1903 | Chapman | 219/284 X |
| 1,169,261 | 1/1916 | Huff | 166/61 X |
| 1,436,089 | 11/1922 | Gorlov | 219/289 |
| 1,474,638 | 11/1923 | Martin | 219/291 |
| 1,661,971 | 3/1928 | Seymour | 219/277 |
| 2,076,669 | 4/1937 | Redfield et al. | 219/277 |
| 2,350,429 | 6/1944 | Troupe | 219/277 X |
| 3,371,713 | 3/1968 | Silverman | 166/303 X |
| 3,420,301 | 1/1969 | Riley et al. | 219/278 X |
| 4,378,846 | 4/1983 | Brock | 219/278 X |

FOREIGN PATENT DOCUMENTS

| | | | |
|---|---|---|---|
| 122113 | 11/1959 | U.S.S.R. | 219/278 |

*Primary Examiner*—Anthony Bartis
*Attorney, Agent, or Firm*—Harlan P. Huebner

[57] ABSTRACT

A downhole heating generator for producing steam or hot water in oil wells to aid in the recovery of oil includes an elongated cylindrical housing suspended by a cable within the tube string of an oil well bore at the level of a geological formation to be heated. The housing has a closed bottom forming a container continously receiving water through a hose from a ground level source and contains a pair of electrode rods, preferably of carbon, mounted in end-to-end spaced aligned relationship and immersed at least partially in the water received in the housing for boiling the water and/or generating steam. The electrodes are connected to a ground level electrical transformer and are arranged to be capable of being energized at at least 2300 volts without arcing therebetween. The steam or hot water is discharged from the housing through an upper exit opening and is directed through openings in the tube string to the geological formation to be heated. A plurality of generators may be suspended in tandem in the tube string.

5 Claims, 2 Drawing Sheets

DOWNHOLE ELECTRIC STEAM OR HOT WATER GENERATOR FOR OIL WELLS

BACKGROUND OF THE INVENTION

1. Field of the Invention.

This invention relates to a downhole heating generator for producing hot water or steam in oil wells to aid in the recovery of oil.

2. Description of the Prior Art.

In the recovery of petroleum hydrocarbons certain geological formations may be encountered that prevent the full or an economical recovery of the petroleum. In some instances the viscosity of the oil or petroleum also bears on recovery.

Thus, steam or hot water has in the past been applied to the downhole formation to change the oil viscosity and unplug openings making the same readily available for pumping to the surface. Such steam or hot water may be applied in both primary and secondary recovery of the petroleum.

Heretofore, heating techniques have required above ground steam generators which prepare the steam at ground level and the same is pumped downhole for dispersion into the geological foundation. One of the problems with such a method and apparatus is that the steam will become dissipated during its downward travel in the tube strings. It is estimated that if the tube strings are not insulated this process is only effective to about 2,000 feet. With an insulated tube string the efficiency will only be extended downward for another 1000 feet.

Another recognized steam technique is known as a hydrocarabon-fueled generator. This system also employs ground level equipment, but to increase the efficiency the energy must be increased by an air compressor for air and hydrocarbons to produce a dry steam at the area of contact with the formation. This process involves extremely complicated control means. In addition, the process causes serious downhole corrosion problems. This process is extremely expensive.

Finally, there is known through U.S. Pat. No. 3,420,301 a form of steam generator which may be moved downhole to the area desired. This patent discloses only concentric electrodes which are connected to a ground level electric transformer and water that is pumped to the electrode area. In principle, as the electrodes are energized the water is heated and steam produced. However, testing of the disclosure in U.S. Pat. No. 3,420,301 shows that the annular gap between the electrodes was too small to adequately heat the number of gallons per minute (GPM) necessary to create an efficient steam generator.

In view of the diameter restriction in a tube string of an oil well there must also be a diameter restriction in a generator casing. Thus, the concentric electrodes are not effective because the space is usually less than one inch. Also, should the center core electrode in U.S. Pat. No. 3,420,301 be reduced in diameter and the gap slightly increased there would still not be sufficient spacing. Further, if the center core electrode diameter were greatly reduced the electrode would not be able to withstand the current necessary to work with electrodes to produce adequate GPM's.

SUMMARY OF THE INVENTION

It is a purpose of the present invention to provide a downhole heating generator that is capable of producing steam from at least a minimum waterflow of 4.5 GPM's.

It is a further object of the invention to provide a downhole heating generator capable of receiving at least 2300 volts of electricity without harmful arcing between the respective electrodes.

Another object of the present invention is to provide a downhole heating generator that may produce hot water to be used to flush an oil well surrounding geological formation.

It is another object of the invention to provide a downhole heating generator of such a construction that the electrodes used therein for heating and vaporization purposes are of such construction as to assure adequate spacing to prevent arcing without having to increase the diameter of the bore or tube string.

A still further object of the invention is to provide a downhole heating generator which may be utilized with other downhole steam generators in tandem to effect a steaming of a larger geological formation.

Another object is to provide a downhole heating generator which is compact and does not require large ground or surface level for equipment. Thus, the unit could effectively be used on an ocean drilling platform as well as on land.

A further object is to provide a generator that does not emit pollutants into the air or underground. This should receive favorable approval by the Environmental Protection Agency.

It is another object of the invention to provide electrodes either in longitudinal spaced relationship or in specially constructed horizontal spaced relationship to accomplish the intended result.

A still further advantage of the present invention is to provide diversion means by which the heating generated may escape from the generator at various areas thereof depending on geological areas to be steamed.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
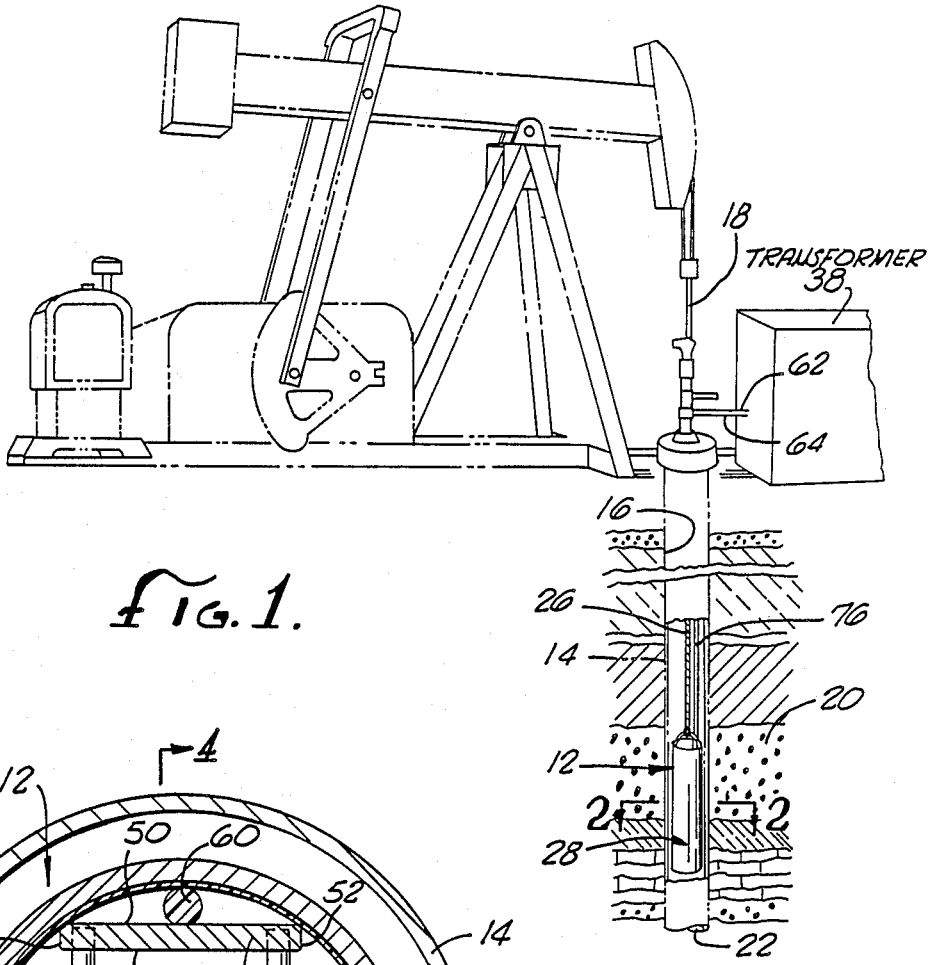
FIG. 1 is an environmental view of the downhole heating generator of the present invention.

Referring to the drawings, in FIG. 1 there is illustrated in phantom a drive means for pumping oil by conventional means. There is also illustrated the present invention namely a downhole heating generator generally designated 12 suspended in a conventional tube or tubing string 14. The string 14 consists of a plurality of cylindrical sections of pipe joined together along their ends to form a continuous length of tubing within the downhole bore 16.

Figure 5:
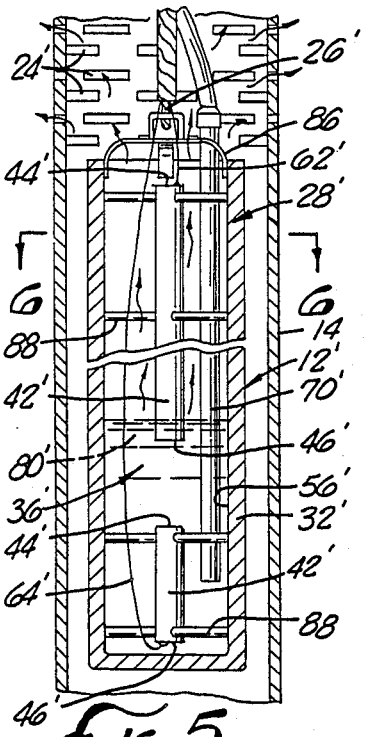
FIG. 5 is a cross-sectional view of a modified electrode arrangement in the steam generator.
Figure 3:
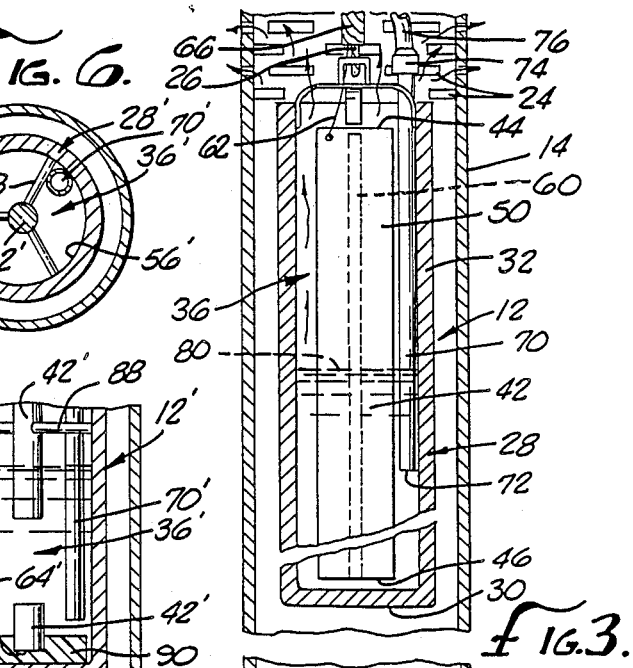
FIG. 3 is cross-sectional view of the invention showing one form of electrode positioning taken on lines 3—3 of FIG. 2.
Figure 4:
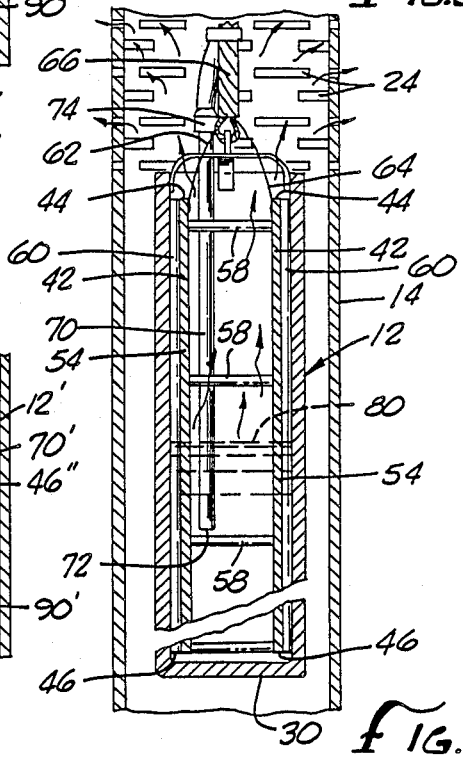
FIG. 4 is a cross-sectional view of the invention taken on lines 4—4 of FIG. 2.

Also extending through the tubing string 14 is a conventional oil well sucker rod 18. This rod activated by the drive means (unnumbered) is usually attached to a pump to draw petroleum hydrocarbons from the geological formations 20 into the open bottom 22 of the string 14, or more particularly through openings 24 in the string 14, as best illustrated in FIGS. 3, 4, and 5.

In the case of highly viscose oil and certain ground formations the openings 24 may be clogged due to both the viscosity of the oil and impurities such as sand, paraffin, etc. This causes a loss of oil in that the pump cannot draw the oil from the formation 20 through the openings 24 and up the string 14 to a storage tank.

In order to reduce the viscosity and/or help to liquefy the paraffin, heat is applied to the string 14 in the vicinity of the openings 24. In order to accomplish this, the present downhole heating generator 12 may be lowered in the string 14 by a cable or other means 26 adjacent the area to be unplugged or liquified.

Figure 9:
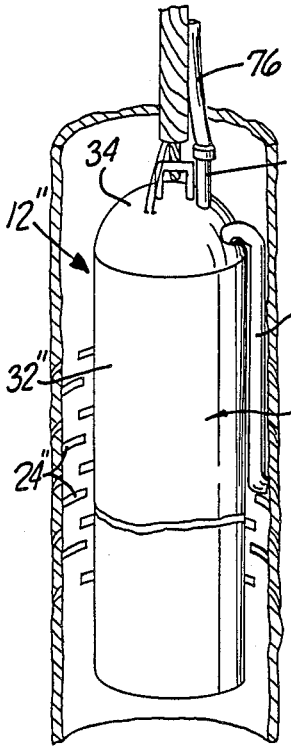
FIG. 9 is a view of the invention with a steam diverter, as suspended in an oil well tube string.

The generator 12 preferably includes an elongated housing 28. The housing 28 is preferably formed of metal and may be any desired length depending upon the feed rate in GPM of water to be converted to steam or to hot water. It might be three feet or longer. The housing 28 includes a bottom 30, an annular wall 32 and may also have a top dome portion or closure member 34 if a closed unit is desired. The intent of the special housing 28 in FIG. 9 is to be closed accept for certain openings. This will be discussed below. In other units the top is open to allow steam to escape.

Preferably, to create the generator or heater within the housing 28, non-concentric electrode means 36 are contained within the housing and electrical means or an electrical transformer 38 above ground will supply current to the electrode means 36.

Figure 2:
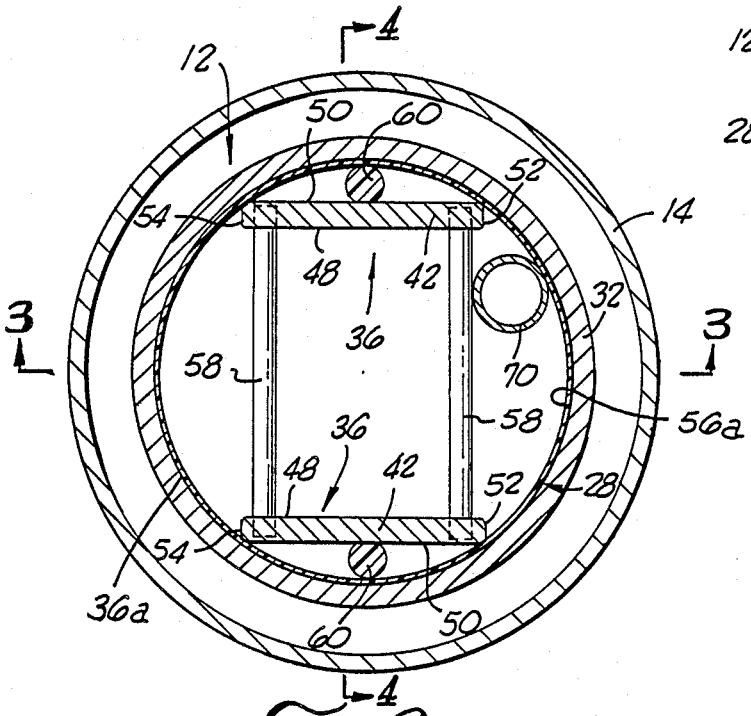
FIG. 2 is a cross-sectional view taken on lines 2—2 of FIG. 1.

In FIGS. 2, 3, and 4 there is illustrated one form of non-concentric electrode means 36. The means 36 is preferably a pair of vertically arranged elongated plate electrodes 42 which are spaced one from the other, as best seen in FIGS. 2 and 4. The electrodes 42 each include a top end 44 and a bottom end 46 spaced away from the bottom 30 of the housing 28. In addition, they each have an inner surface 48 and outer surface 50 and rounded edges 52 and 54.

The non-concentric electrodes 42 are preferably made of carbon such as graphite. Carbon is used because it is a good electrical conductor.

It may be preferred to coat the interior surface 56 of the housing 28 with an insulation material 56*a* (see FIG. 2) such as a high dielectric phenolic resin (not shown) in order to reduce electrical ground loss.

This ground loss could occur in view of the mounting of the plates 42, best seen in FIG. 2. The non-concentric electrodes 42 are mounted within the housing 28 where the edges 52 and 54 of each electrode 42 touch the interior 56, as best seen in FIG. 2. The electrodes are spaced from each other where the interior surfaces 48 are facing each other. As mounted the electrodes 42 define a chord with respect to the inner surface of the annular wall 32.

To maintain the electrodes 42 in the spaced relationship there are provided dielectric phenolic resin or other insulation spaces 58 along the length to maintain the proper relationship.

In addition vertical supports 60 may be used between the outer surfaces 50 and the interior surface 56 of the annular wall 32 of housing 28.

By having the edges 52 and 54 rounded it has been found that smooth current flow is also achieved.

Preferably adjacent the top 44 of each of the electrodes there are couplings to electrical cables 62 and 64 respectively. These cables may project upward within a conduit 66 surrounding the cable 26 and electrical cables 62 and 64 to the electrical transformer 38 at ground level.

In addition, the housing 26 has mounted therein a water discharge means including a pipe 70 which terminates in end 72. Coupled to the pipe 70 adjacent the upper end of the generator by coupling means 74 is a water hose 76 which also extends up the string 14 to a source of water, not shown, at ground level.

Thus, in operation, water 80 is pumped down hose 76, through pipe 70 into the bottom of the housing 28, see FIGS. 3 and 4. The electrical transformer 38 is then activated passing voltage down the cables 62 and 64 to the respective electrodes 42. Such energization of the electrodes and electrical interaction will in turn heat the water 80 vaporizing the same to make steam or depending upon the heat generated will produce boiling water to accomplish the desired results.

In the case of the construction in FIGS. 3 and 4, with the top open, the steam will rise as seen by the arrows, pass out of the open top end of the housing 28 and be directed to the openings 24 of the string 14. In this way the steam can penetrate openings and either clean them out and/or reduce the viscosity of the oil for proper pumping.

It has been found in some testing that a voltage of 2300 volts from the transformer 38 to the electrodes will be able to vaporize 3.0 to 4.5 GPM (gallons per minute) when the electrodes 42 are approximately 3 inches apart.

A problem with prior art units is that a smaller gap of less than 3 inches at such voltage, as set out above, will cause an arc out or corona of the electrodes and prevent vaporization or water heating. It can also be appreciated that as the length of the generator 12 is increased additional voltage may be required to acieve a vaporization rate which is equivalent to an increased GMP water feed rate that will carry out the intended result.

In view of the lateral restraint due to the diameter of a string 14, approximating 4 inches, there is a limitation on the gap that can be achieved. In order to accommodate a larger gap over and above the structure of FIGS. 3 and 4, modified non-concentric positioning may be employed.

Figure 6:
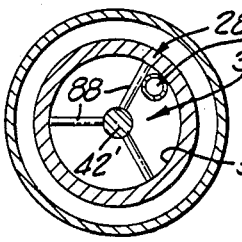
FIG. 6 is a cross-sectional view taken on lines 6—6 of FIG. 5.
Figure 7:
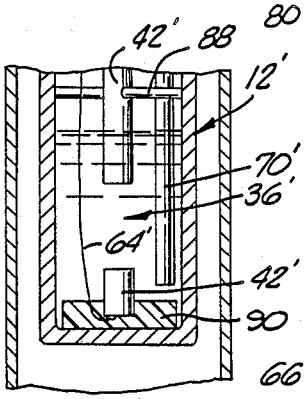
FIG. 7 is a cross-sectional view of a further modified positioning of the electrodes as illustrated in FIG. 5.

In FIGS. 5, 6 and 7 there is a modified arrangement of the non-concentric electrode means 36′ which may be employed.

As shown in FIG. 5 there is the generator means 12′ which is connected by bracket 86 to cable 26′.

The difference resides in the non-concentric electrode means 36' which employ a pair of solid rod electrodes 42' which are in end to end alignment one above the other. The upper and lower electrodes 42' each are preferably elongated and have top ends 44' and bottom ends 46'.

The electrodes 42' are spaced from the interior surface 56' of the housing 28' affixed by struts 88 which extend to the annular wall 32'.

As can be seen from FIG. 5 there is a space between the lower end 46' of the upper electrode 42' and the top end 44' of the lower electrode 42'. Depending upon the voltage that is desired to be passed to the non-concentric electrodes 42' through cables 62' and 64', the gap can be increased so that arcing is prevented yet will heat the water 80'.

In addition, with the arrangement of FIG. 5 the diameter of the rod electrodes 42' can be increased to withstand increased voltage without disintegrating.

Again water 80' is pumped into the housing 28' through water pipe 70' for vaporization to steam for passage out the housing 28' to the openings 24'.

In the case of FIG. 7 the lower rod electrode 42' may be embedded in a block of high dielectric material such as phenolic resin 90 so that electrical grounding is prevented.

Figure 8:
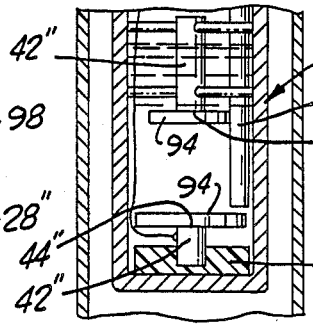
FIG. 8 is a cross-sectional view of a further modification of the electrodes as illustrated in FIGS. 7 and 8.

FIG. 8 illustrates the same type of rod electrodes 42'' where the lower electrode is embedded in the insulation block 90' like FIG. 7. However, the difference resides in the construction of an annular electrode plate member 94 to the lower end 46'' of the upper rod 42'' and a plate member 94 to the upper or top end 44'' of the lower rod 42''. Such arrangement may prove to be more effective because there are greater surfaces for electrical interface between the respective electrodes and to contact the water.

Each of the electrodes 42' and 42'' may also be formed of graphite.

In FIG. 9 there is illustrated the generator 12'' wherein the housing 28'' is closed by the top dome portion 34. This arrangement is created so that the steam of the vaporized water may be channeled out of another steam exit opening, a steam discharge pipe 98 down the outside of the annular wall 32'' to openings 24'' which may be below the top of the generator 12''.

Figure 10:
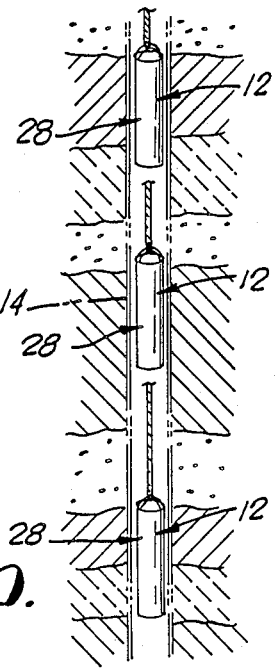
FIG. 10 is a view illustrating the tandem arrangement of several downhole heating generators within a tube string.

In FIG. 10 there is illustrated a series of generators 12 in tandum within the downhole bore 16. This arrangement can assure the heating of a greater area of a formation than with a single generator 12.

The invention and its attendant advantages will be understood from the foregoing description and it will be apparent that various changes may be made in the form, construction, and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity or reading and not for emphasis.

I claim:

1. A downhole heating generator for use in an oil well bore for the heating of water or the vaporization of water to steam wherein there is a cylindrical tube string within said bore which extends between the surface and the bottom of the bore, and there are cable mean adapted to be secured to the generator to raise and lower the generator within the tube string to an area where it is desired to either apply boiling water to steam directly to openings in the tube string or to a geological formation adjacent the tube string comprising:

a hollow elongated cylindrical housing adapted to be inserted into the tube string of a well and having a diameter less than that of the tube string and including a cylindrical vertical side wall and a closed bottom forming therewith a container adapted to receive and hold a quantity of water and at least one exit opening at the upper end of said housing for discharge of steam or boiling water, said upper end coupled to said cable means;

an electric heater within said housing said heater including a single pair of non-concentric electrodes in electrically insulated spaced relationship one from the other, said electrodes each including at least some portions adapted to be submerged in and surrounded by water adapted to be received in said container;

electrical coupling means on said housing for electrically connecting said electrodes to an electric cable adapted to extend through the tube string to an electrical transformer adapted to be located at the surface;

water supply means associated with said housing terminating in a discharge means in said housing and adapted to carry water from the surface to assure a continual flow of water into said housing during the heating of said water by said heater; and wherein said electrodes are upper and lower rods mounted within said housing in end to end spaced aligned relationship one from the other at a distance sufficient to prevent arcing applied at voltages necessary to heat a continuous volume of water therearound.

2. A downhole heating generator as defined in claim 1 wherein said rods are centrally located within said cylindrical side wall; and strut means extend between said rods and said annular wall to fixedly mount said electrodes therein.

3. A downhole heating generator as defined in claim 1 wherein said lower electrode is spaced from said bottom of said housing by dielectric material.

4. a downhole heating generator as defined in claim 1 wherein said exit opening includes an opening at the top of said housing wherein the steam generated is adapted to rise out of said housing to the tube string openings.

5. A downhole heating generator as defined in claim 1 wherein said elongated housing includes:

an open top;

a cap to enclose said open top of said housing; and said exit opening includes a pipe projecting from said cap laterally of said side wall and down said housing to a predetermined point and at said point is bent laterally of said side wall toward and terminating adjacent openings in the tube string.

* * * * *